US007770652B2

(12) United States Patent
Barnett

(10) Patent No.: US 7,770,652 B2
(45) Date of Patent: Aug. 10, 2010

(54) BALL RELEASE PROCEDURE AND RELEASE TOOL

(75) Inventor: Robert Barnett, Calgary (CA)

(73) Assignee: BBJ Tools Inc., Calgary (CA)

( * ) Notice: Subject to any disclaimer, the term of this patent is extended or adjusted under 35 U.S.C. 154(b) by 284 days.

(21) Appl. No.: 12/045,106

(22) Filed: Mar. 10, 2008

(65) Prior Publication Data

US 2008/0223586 A1 Sep. 18, 2008

Related U.S. Application Data

(60) Provisional application No. 60/894,564, filed on Mar. 13, 2007.

(51) Int. Cl.
*E21B 34/10* (2006.01)
*E21B 34/00* (2006.01)
*E21B 43/12* (2006.01)

(52) U.S. Cl. ..... 166/374; 166/193; 166/329; 166/334.1; 137/624.27

(58) Field of Classification Search ..... 166/193, 166/318, 329, 334.1, 374, 386; 137/624.27, 137/496; 251/73
See application file for complete search history.

(56) References Cited

U.S. PATENT DOCUMENTS 2,737,244 A * 3/1956 Baker et al. ..... 166/124
3,269,463 A * 8/1966 Page, Jr. ..... 166/329
3,332,498 A * 7/1967 Page, Jr. ..... 166/321
3,568,768 A * 3/1971 Rowell, Jr. ..... 166/72
3,584,645 A 6/1971 Radig
3,850,191 A * 11/1974 Brown ..... 137/271
3,850,194 A 11/1974 Brown
4,040,441 A * 8/1977 Brown et al. ..... 137/519.5
4,108,203 A * 8/1978 Brown ..... 137/496
4,171,019 A 10/1979 Cole
4,452,322 A * 6/1984 Jurgens ..... 175/107
6,220,360 B1 4/2001 Connell et al.
7,100,700 B2 9/2006 Davis et al.
7,624,810 B2 * 12/2009 Fould et al. ..... 166/387
2004/0055753 A1 * 3/2004 Davis et al. ..... 166/318
2005/0145417 A1 * 7/2005 Radford et al. ..... 175/57
2008/0105465 A1 * 5/2008 Radford et al. ..... 175/57
2008/0223586 A1 * 9/2008 Barnett ..... 166/386

* cited by examiner

*Primary Examiner*—Jennifer H Gay
(74) *Attorney, Agent, or Firm*—Bennett Jones LLP

(57) ABSTRACT

A ball release tool includes: a tubular body including an upper end, a lower end, an inner bore defined by an inner wall surface and extending from the upper end to the lower end; a pocket in the inner wall; a slidable sleeve carried by the tubular body and including a throughbore positioned in line with the tubular body inner bore, the slidable sleeve moveable along the inner bore from a first position substantially covering the pocket to a second position exposing the recess to the inner bore; a check valve in driving communication with the sleeve, the check valve selected to permit flow of fluid through the inner bore from the upper end to the lower end, but to act against flow from the lower end to the upper end and, when resisting flow, operable to drive the sleeve upwardly toward the second position, and a ball positionable in the pocket to be either held in the pocket behind the sleeve or released into the inner bore when the sleeve exposes the pocket.

9 Claims, 1 Drawing Sheet

BALL RELEASE PROCEDURE AND RELEASE TOOL

FIELD

The present invention relates to downhole tools and, in particular, a tool for releasing a ball actuator downhole.

BACKGROUND

Some downhole tools are actuated by a ball, or other form of plug included herein under the term "ball", which is intended to be useful to create a hydraulic pressure of actuation. Examples of various downhole tools requiring launched ball actuation are tools with sliding sleeve valves, liner hangers, etc.

In use, a ball may be released to travel through the well's tubular string to land in a valve seat in the string inner bore in order to create a pressure differential to operate the tool hydraulically. Generally, such a ball is launched from surface. However, in some instances, for example, when unable to pump the ball or to release the ball through the running string, it may be useful to launch a ball from a downhole location.

SUMMARY

In accordance with one broad aspect of the present invention, there is provided a ball release tool comprising: a tubular body including an upper end, a lower end, an inner bore defined by an inner wall surface and extending from the upper end to the lower end; a pocket in the inner wall; a slidable sleeve carried by the tubular body and including a through-bore positioned in line with the tubular body inner bore, the slidable sleeve moveable along the inner bore from a first position substantially covering the pocket to a second position exposing the recess to the inner bore; a check valve in driving communication with the sleeve, the check valve selected to permit flow of fluid through the inner bore from the upper end to the lower end, but to act against flow from the lower end to the upper end and, when resisting flow, operable to drive the sleeve upwardly toward the second position, and a ball positionable in the pocket to be either held in the pocket behind the sleeve or released into the inner bore when the sleeve exposes the pocket.

In accordance with another broad aspect of the present invention, there is provided a method for releasing an actuator ball to pass downhole, the method comprising: providing an actuator ball in a downhole tubular retained in a recess behind a sliding sleeve during normal flow of fluid through the inner bore of the downhole tubular; reversing flow through the downhole tubular, causing the sleeve to move and release the actuator ball into the inner bore; and resuming normal flow of fluid to convey the actuator ball downhole away from the downhole tubular.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 2:
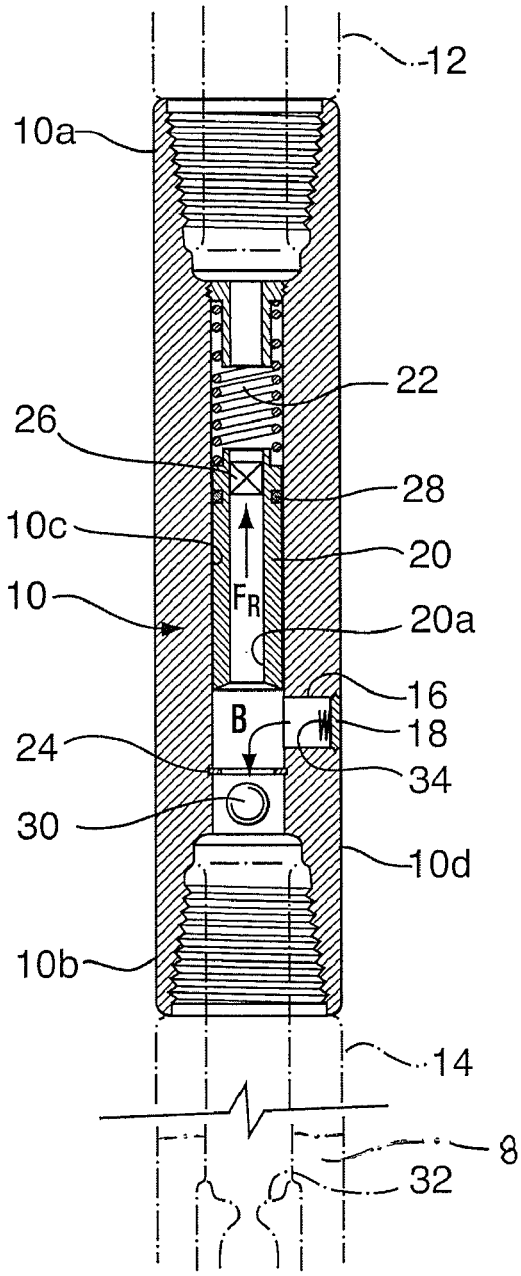
FIG. 2 is a schematic sectional view through a ball release tool, where the tool has been actuated to release the ball.

A ball release tool may be formed as a sub for installation into a string of tubulars. The tool and its method of use allows a ball to be released downhole to activate a tool, such as a liner hanger (item 8 in FIG. 2), fracing port, etc. As such, the tool may be useful in situations where it is difficult to pump or release a ball at surface.

A ball release sub may be placed in the tubular string above the tool to be actuated by the ball and below any tools that will inhibit passage therethrough of the ball, such as tools that are used to force the liner into the hole, which will not allow a ball to pass internally through the string.

The ball release sub includes a pocket machined into the sub wall and an internal sleeve to hold the ball in place in the pocket. The ball would be placed in the pocket from the external of the sub and secured with a threaded plug. The sleeve may be connected to a check valve that allows flow down thru the running string and tools and, thereby, through the sleeve and sub, but does not allow flow up through the running string and tools. The check valve and the sleeve may be held down with a spring positioned to act against the sleeve or with shear pins.

When it is time to release the ball into the inner bore, the circulation through the well would be reversed, wherein flow of fluid would be down the annulus and up the running string. This flow causes the check valve to close. Pressure would then be exerted against the closed check valve, causing the sleeve to move upward away from its position covering the pocket and out of the path of the ball such that the ball can enter the string inner bore. The fluid circulation is then redirected down the internal of the string and the ball would be conveyed by being pumped along with the fluid to its seat in the tool to be actuated thereby.

Figure 1:
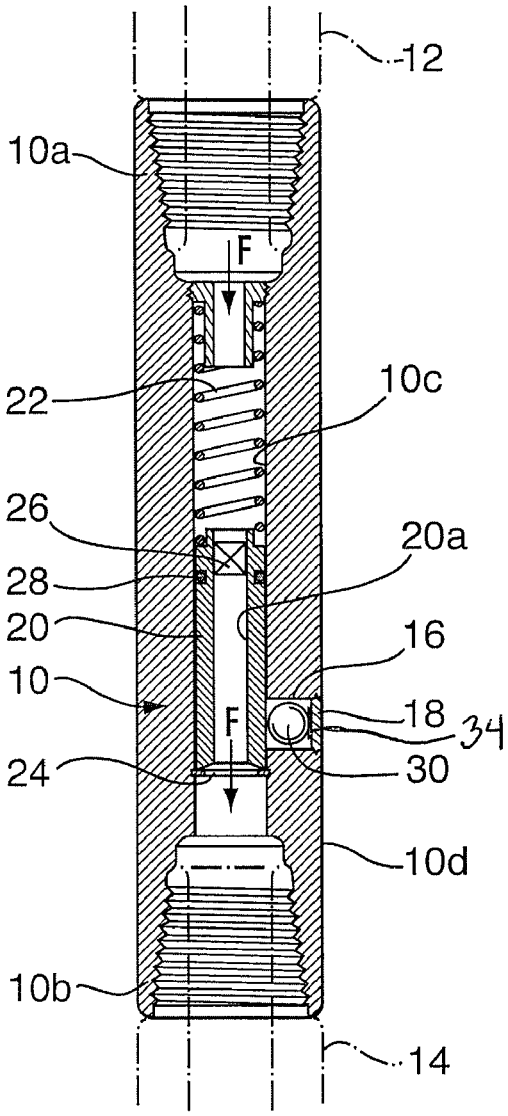
FIG. 1 is schematic sectional view through a ball release tool.

FIG. 1 shows one embodiment of a ball release sub. The ball release sub includes a tubular body 10 formed at its upper end 10*a* and lower end 10*b* for connection into a tubular string. For example, ends 10*a*, 10*b* may be threaded or for threaded connection to adjacent tubulars above 12 and below 14, as is usual in wellbore strings. Tubular body 10 includes an inner bore 10*c* extending from end 10*a* to end 10*b*.

A ball pocket 16 is formed in the inner wall of the tubular body. In the illustrated embodiment, pocket 16 extends fully from an opening to inner bore 10 through to an opening to the exterior surface 10*d* of the tubular member. In such an embodiment, pocket 16 includes a removable cap 18 that closes the pocket at its exterior surface, but may be removed to access the pocket from outside the sub, if desired. Cap 18 may be formed to seal against fluid leakage thought the tubular wall at pocket 16 such that fluid circulation is not allowed to bypass at that point.

A sliding sleeve 20 is positioned for axial sliding movement within the inner bore. Sliding sleeve 20 includes a through bore 20*a* that is substantially coaxially positioned with inner bore 10*c*. Although not shown, the inner diameter of inner bore 10*c* and through bore 20*a* may be substantially the same as the selected minimum inner diameter of the remainder of the string.

Sliding sleeve 20 is moveable from a first position (FIG. 1) substantially covering pocket 16 and a second position (FIG. 2) away from a blocking position over pocket 16 such that the pocket is opened to inner bore 10*c*. Sliding sleeve 20 is normally maintained in the first position, as by being biased or pinned in that position. For example, in the illustrated embodiment, sleeve 20 is biased into a position covering the pocket by a spring 22. Spring 22 drives the sleeve downwardly toward end 10*b* against a stop 24. However, spring 22 can be compressed to allow the sleeve to move away from the stop. Other means can be used to control the movement of the sleeve, as desired, such as shear pins.

A check valve 26 is mounted in drive communication with sleeve 20. Check valve 26 is configured to allow fluid flow, as shown by arrows F of FIG. 1, in a direction from upper end 10*a* to lower end 10*b*, but resists or stops fluid flow in a reverse direction, as shown by arrows $F_R$ of FIG. 2. Thus, check valve 26 allows normal fluid circulation from surface down through the string and up the annulus but acts against reverse circulation. This configuration allows the check valve 26 to act to drive the sleeve, when the well is reverse circulated. Thus allows pocket to be selectively opened by controlling fluid flow in the well. In particular, during reverse circulation, check valve 26 creates a pressure differential above and below it, which acts to lift the sleeve toward the low pressure, upper side (toward upper end 10*a*). Spring 22 or shear pins are employed to control the movement of the sleeve such that only pressures similar to that created during reverse flow, rather than lesser, occasional backpressures, are capable of moving the sleeve.

If desired, suitable seals may be provided, such as O-rings 28 to prevent leakage of fluid past the sleeve.

The ball release sub is intended to release a ball when the sleeve is raised. As such, a ball 30 may be positioned in pocket 16. Sleeve 20 acts to block release of the ball from the pocket when in the first position. However, ball 30 can move out of pocket 16, arrows B, past the sleeve when the sleeve is in the second position, raised out of a blocking position over the pocket. Ball 30 may be placed in the pocket at surface as by introducing the ball through the inner bore or, where there is a removable cap 18, by removing the cap and inserting the ball. The ball can be installed prior to introducing the string into the well and the ball resides in the pocket, as by the blocking position of the sleeve, until it is desired to release the ball from the pocket.

During normal operation, sleeve 20 maintains the ball in the pocket and fluid circulation is substantially not affected by the sleeve and check valve 26. However, upon reverse circulation, arrows $F_R$, the fluid pressure lifts the sleeve, such that the ball can be released from the pocket, arrows B. Thereafter, normal fluid circulation can be resumed to convey the ball to its seat 32. The ball is of a diameter selected to pass through the inner diameter of the string to its seat. The seat may be downstream from lower end 10*b* and thus ball 30 is selected to at least pass through the inner bore diameter at lower end 10*b*.

A spring 34 may be positioned in pocket 16, between a back wall of the pocket and the open area behind sleeve 20, to act against a ball contained therein and force it out of the pocket, when sleeve 20 is removed from over the opening to inner bore 10*c*.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A ball release tool comprising: a tubular body including an upper end, a lower end, an inner bore defined by an inner wall surface and extending from the upper end to the lower end; a pocket in the inner wall; a slidable sleeve carried by the tubular body and including a throughbore positioned in line with the tubular body inner bore, the slidable sleeve moveable along the inner bore from a first position substantially covering the pocket to a second position exposing the recess to the inner bore; a check valve in driving communication with the sleeve, the check valve selected to permit flow of fluid through the inner bore from the upper end to the lower end, but to act against flow from the lower end to the upper end and, when resisting flow, operable to drive the sleeve upwardly toward the second position, and a ball positionable in the pocket to be either held in the pocket behind the sleeve or released into the inner bore when the sleeve exposes the pocket.

2. The ball release tool of claim 1 further comprising a spring to bias the slidable sleeve into the first position.

3. The ball release tool of claim 1 further comprising a spring in the pocket to bias the ball against the slidable sleeve.

4. The ball release tool of claim 1 wherein the ball is sized to pass through the inner bore at the lower end to pass downhole away from the tool.

5. The ball release tool of claim 1 wherein the check valve is mounted in a throughbore of the sleeve in line with the inner bore.

6. The ball release tool of claim 1 further comprising a removable cap to the pocket on an exterior surface of the tubular body.

7. A method for releasing an actuator ball to pass downhole, the method comprising: providing an actuator ball in a downhole tubular retained in a recess behind a sliding sleeve during normal flow of fluid through the inner bore of the downhole tubular; reversing flow through the downhole tubular, causing the sleeve to move and release the actuator ball into the inner bore; resuming normal flow of fluid to convey the actuator ball downhole away from the downhole tubular; and landing the ball in a ball seat to actuate a tool downhole.

8. The method of claim 7 wherein the tool is a liner hanger.

9. A method for releasing an actuator ball to pass downhole, the method comprising: providing an actuator ball in a downhole tubular retained in a recess behind a sliding sleeve during normal flow of fluid through the inner bore of the downhole tubular; reversing flow through the downhole tubular, causing the sleeve to move and release the actuator ball into the inner bore; and resuming normal flow of fluid to convey the actuator ball downhole away from the downhole tubular, wherein causing the sleeve to move includes generating a back pressure against a check valve to lift the sleeve.

* * * * *